United States Patent [19]

Takagi et al.

[11] Patent Number: 4,540,655

[45] Date of Patent: Sep. 10, 1985

[54] METHOD OF PROCESSING A DIRECT POSITIVE SILVER HALIDE PHOTOGRAPHIC LIGHT-SENSITIVE MATERIAL

[75] Inventors: Yoshihiro Takagi; Shigeo Hirano; Tadao Sugimoto, all of Kanagawa, Japan

[73] Assignee: Fuji Photo Film Co., Ltd., Kanagawa, Japan

[21] Appl. No.: 660,241

[22] Filed: Oct. 11, 1984

Related U.S. Application Data

[63] Continuation of Ser. No. 428,514, Sep. 29, 1982, abandoned.

[30] Foreign Application Priority Data

Sep. 29, 1981 [JP] Japan ..... 56-154116

[51] Int. Cl.[3] ..... G03C 5/24

[52] U.S. Cl. ..... 430/410; 430/409; 430/485

[58] Field of Search ..... 430/409, 596, 598, 485, 430/410

[56] References Cited

U.S. PATENT DOCUMENTS

| | | | |
|---|---|---|---|
| 2,588,982 | 3/1952 | Ives | 430/409 |
| 3,050,392 | 8/1962 | Eerde | 430/485 |
| 4,030,925 | 6/1977 | Leone et al. | 430/598 |
| 4,245,037 | 1/1981 | Tsujino et al. | 430/598 |
| 4,323,643 | 4/1982 | Mifune et al. | 430/598 |
| 4,374,923 | 2/1983 | Hirano et al. | 430/598 |

*Primary Examiner*—Won H. Louie

*Attorney, Agent, or Firm*—Sughrue, Mion, Zinn, Macpeak, and Seas

[57] ABSTRACT

A method of processing a direct positive silver halide photographic light-sensitive material which comprises processing a direct positive silver halide photographic light-sensitive material comprising a support having coated thereon at least one hydrophilic colloid layer containing a compound represented by the following general formula (I):

$$R^1NHNHCOR^2 \quad (I)$$

wherein $R^1$ represents an unsubstituted or substituted aryl group or an unsubstituted or substituted alkyl group; and $R^2$ represents a hydrogen atom, an unsubstituted or substituted aryl group or an unsubstituted or substituted alkyl group, with a developing solution containing not less than 25 g per liter of a hydroquinone and having a pH of from 11.0 to 13.0. According to the processing method an excellent reversal photographic image can be obtained using a high pH type developing solution which is stable wherein a change of pH due to exhaustion and aerial oxidation is considerably small.

34 Claims, No Drawings

METHOD OF PROCESSING A DIRECT POSITIVE SILVER HALIDE PHOTOGRAPHIC LIGHT-SENSITIVE MATERIAL

This is a continuation of application Ser. No. 428,514, filed 9/29/82, abandoned.

BACKGROUND OF THE INVENTION

The present invention relates to a processing method for developing a silver halide photographic light-sensitive material which can be utilized to form a direct positive photographic image. More particularly, it relates to a method of development processing to carry out a stable processing of a direct positive type photographic light-sensitive material wherein a silver halide emulsion layer or other hydrophilic colloid layer contains a novel compound as a fogging agent with a developing solution having a pH of not less than 11.

In the field of silver halide photography, a photographic method in which a positive photographic image is obtained without using a negative image or an intermediate process producing a negative image, is called a direct positive photographic method. A photographic light-sensitive material and a photographic emulsion using such a photographic method are called a direct positive photographic light-sensitive material and a direct positive photographic emulsion, respectively.

A variety of direct positive photographic methods are known. The most useful methods are a method in which silver halide grains which have previously been fogged are exposed to light in the presence of a desensitizer followed by development, and a method comprising exposing a silver halide emulsion containing silver halide grains having light-sensitive specks mainly inside the silver halide grains to light and then developing the exposed emulsion in the presence of a fogging agent. The present invention relates to the latter method. A silver halide emulsion processing light-sensitive specks within the silver halide grains and which forms latent images mainly inside the grains is referred to as an internal latent image type silver halide emulsion, and thus are distinguished from silver halide grains which form latent images mainly on the surface of the grains.

Methods for obtaining a direct positive image by surface-developing an internal latent image type silver halide photographic emulsion in the presence of a fogging agent, and photographic emulsions and photographic light-sensitive materials employed in such methods are disclosed in U.S. Pat. Nos. 2,456,953, 2,497,875, 2,497,876, 2,588,982, (all of which are incorporated herein by reference to disclose such methods, emulsions, agents and materials) 2,592,250, 2,675,318, 3,227,552 and 3,761,276, British Pat. Nos. 1,011,062 and 1,151,363, Japanese Patent Publication No. 29405/68, etc.

In the internal latent image type method for obtaining a direct positive image, the fogging agent can be incorporated into a developing solution. However, by incorporating the fogging agent into the photographic emulsion layer or other layers of the photographic light-sensitive material, thereby adsorbing the fogging agent onto the surface of the silver halide grains, better reversal characteristics can be obtained.

Fogging agents which can be employed in the above-described method for obtaining a direct positive image include hydrazine and derivatives thereof as described in U.S. Pat. Nos. 2,563,785, 2,588,982 and 3,227,552, respectively. In particular, U.S. Pat. No. 3,227,552 discloses that hydrazide and hydrazine type compounds which are derivatives of hydrazine can be incorporated not only in the developing solution, but also in the light-sensitive layers.

Further, it has been proposed in U.S. Pat. No. 4,030,925 (corresponding to German Patent Application (OLS) No. 2,635,316) and U.S. Pat. No. 4,031,127 (corresponding to German Patent Application (OLS) No. 2,635,317) that acyl hydrazinophenylthiourea compounds be employed.

However, these known fogging agents are accompanied by several disadvantages, viz., they have an adverse influence on preservability of the direct positive photographic light-sensitive material, they are deficient in fogging ability for internal latent image type silver halide grains having small particle size, their reversal characteristics vary greatly depending upon changes in bromine ion concentration in the developing solution used, and their reversal characteristics vary widely depending upon changes in the amount used.

However, when an internal latent image type silver halide photographic light-sensitive material containing the above described hydrazine derivatives as a fogging agent is developed, development is not initiated without adjusting the pH of a developing solution to not less than 11.0 and as a result D max can not be obtained. This is because the fogging action of the fogging agent occurrs only when the pH is not less than 11.0. Accordingly, when a hydrazine type fogging agent is employed, it is necessary to maintain the pH of the developing solution higher than that of conventional developing solutions. However, the pH of the developing solution is varied due to aerial oxidation and the exhausted product during processing which results in the fundamental defects of changes in the photographic properties such as sensitivity, gradation, Dmax, Dmin, etc. Recently, in order to prevent the high pH developing agent from oxidation by air, some attempts have been made in which the high pH development is carried out while avoiding contact with air. For example, a method is used in which a processing solution is rendered viscous and sealed up by putting it into a pod. Processing is then carried out by mechanically rupturing the pod just before development. In accordance with another method a developing solution is put into a sealed container and the developing solution is sprayed on the photographic light-sensitive material using a spray method. However, these methods have disadvantages such as they are not capable of processing as large an area as a dip type processing system. Furthermore, the mechanism of the processing machine becomes complicated. Therefore, these methods are not suitable for practical use. Accordingly, it is desirable to develope a processing method which is stable even at a high pH and which can be applicable to conventional dip type processing machines.

When a silver halide photographic light-sensitive material is processed, the pH of the processing solution decreases, the amount of halogen increases and the developing agent and sulfurous acid are consumed. Processing solutions of this type are called exhausted processing solutions. Photographic light-sensitive materials containing a fogging agent are particularly susceptible to a change in pH and the sensitivity and Dmax thereof are remarkably affected. Sodium carbonate or trisodium phosphate is conventionally used as a buffer in connection with such processing solutions. However, these buffers are not desirable because they are only effective at a pH of up to about 10 and have no buffering function at a pH of about 11 and 12.

SUMMARY OF THE INVENTION

An object of the present invention is to provide a method of processing a direct positive photographic light-sensitive material.

Another object of the present invention is to provide a processing method in which a stable high pH type developing solution is used wherein any change in pH due to processing exhaustion and aerial oxidation is small.

A further object of the present invention is to provide a method of processing a direct positive photographic light-sensitive material wherein the reversal property is excellent.

A still further object of the present invention is to provide a method of processing a direct positive photographic light-sensitive material wherein the preservation property is excellent.

Other objects of the present invention will become apparent from the following detailed description and examples.

It has been found that the above described objects of the present invention are achieved by processing a direct positive silver halide photographic light-sensitive material comprising a support having coated thereon at least one hydrophilic colloid layer containing a compound represented by the following general formula (I):

$$R^1NHNHCOR^2 \qquad (I)$$

wherein $R^1$ represents an unsubstituted or substituted aryl group or an unsubstituted or substituted alkyl group; and $R^2$ represents a hydrogen atom, an unsubstituted or substituted aryl group or an unsubstituted or substituted alkyl group, with a developing solution containing not less than 25 g per liter of a hydroquinone and having a pH Of from 11.0 to 13.0.

DETAILED DESCRIPTION OF THE INVENTION

Hereinafter the compounds represented by the general formula (I) will be explained in greater detail.

In general formula (I), the aryl group which may be substituted represented by $R^1$ is a mono- or dicyclic aryl group, including a benzene ring and a naphthalene ring. Particularly preferred among them is the benzene ring.

The aryl group may be substituted, and examples of preferred substituents include a straight, branched, or cyclic alkyl group preferably containing from 1 to 20 carbon atoms, for example, a methyl group, an ethyl group, an isopropyl group, an n-dodecyl group, etc., an aralkyl group preferably a mono- or dicyclic aralkyl group having an alkyl moiety containing from 1 to 3 carbon atoms, for example, a benzyl group, etc., an alkoxy group preferably containing from 1 to 20 carbon atoms, for example, a methoxy group, an ethoxy group, etc., a substituted amino group, preferably substituted with an alkyl group containing from 1 to 20 carbon atoms, for example, a dimethylamino group, a diethylamino group, etc., an aliphatic acylamino group preferably having an alkyl group containing from 2 to 21 carbon atoms, for example, an acetylamino group, a heptylamino group, etc., an aromatic acylamino group preferably having a mono- or dicyclic aryl group, for example, a benzoylamino group, etc., or a group represented by the formula $X\text{-}(Y)_n$.

In the group represented by the formula $X\text{-}(Y)_n$, n represents 0 or 1; Y represents a divalent connecting group, for example, —CONH—, —$R^{11}$—CONH—, —O—$R^{11}$—CONH—, —S—$R^{11}$—CONH—, —$R^{11}$—, —$R^{11}$—O—$R^{12}$—, —$R^{11}$—S—$R^{12}$—, —$SO_2$NH—, —$R^{11}$—$SO_2$NH—, —NHCONH—, —$CH_2$—CH=N—, —$R^{11}$—NH—, —$R^{11}$—O—$R^{12}$—CONH—, —NHCO—$R^{11}$, —NHCO—$R^{11}$—CONH—, —$R^{11}$—$R^{12}$—, etc., wherein $R^{11}$ and $R^{12}$ (which may be the same or different) each represents a divalent saturated or unsaturated aliphatic group, for example, an ethylene group, a butenylene group, a 1-methylpropylene group, a 1-methylmethylen group, etc., or a divalent aromatic group which may be substituted with a substituent such as an amino group, for example, a phenylene group, a naphthylene group, a 5-amino-1,2-phenylene group, etc. In —$R^{11}$—$R^{12}$—, $R^{11}$ and $R^{12}$ are different divalent groups.

X represents a group containing a

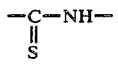

unit, a group containing a

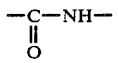

unit, a group represented by

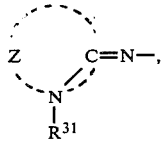

a heterocyclic group, an aralkyl group when n is 1, a substituted aryl group, or a group represented by

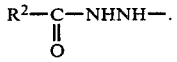

The heterocyclic group represented by X is a 5-membered or 6-membered ring containing at least one hetero atom which may be condensed with an aromatic ring, particularly a benzene ring, and preferably a monovalent group derived from a heterocyclic compound (for example, a 1,2-benzotriazol-5-yl group, a 5-tetrazolyl group, an indazol-3-yl group, a 1,3-benzimidazol-5-yl group, a hydroxytetraazainden-2- or -3-yl group, etc.), monovalent group derived from a heterocyclic quaternary ammonium salt (for example, an N-ethylbenzothiazolinium-2-yl group, an N-sulfoethylbenzothiazolinium-2-yl group, an N,N-diethylbenzimidazolinium-2-yl group, etc.), a monovalent group derived from a heterocyclic compound having a mercapto group (for example, a 2-mercaptobenzothiazol-5- or -6-yl group, a 2-mercapto benzoxazol-5- or -6-yl group, etc.).

The aralkyl group represented by X is a mono- or dicyclic aralkykl group having an alkyl moiety containing 1 to 3 carbon atoms includes, for example, a benzyl group, etc.

The substituted aryl group represented by X is an aryl group substituted with a substituent, for example, an alkyl group, for example, a methyl group, an ethyl group, a propyl group, a butyl group, an amyl group, etc., an alkoxy group, for example, a methoxy group, an ethoxy group, etc., a nitro group, a sulfonamido group, an acetamido group, etc.

When X represents the group containing a

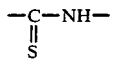

unit or the group containing a

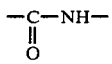

unit, an alkyl moiety included therein is an alkyl group containing 1 to 10 carbon atoms.

The group containing a

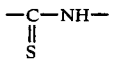

unit represented by X preferably is an

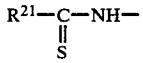

group, an

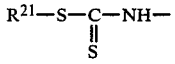

group, an

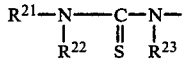

group, an

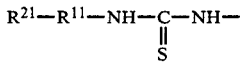

groups, etc.

The group containing a

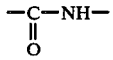

unit represented by X is preferably an

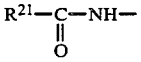

group, or an

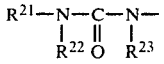

groups, etc.

In the above formulae, $R^{21}$ represents an aliphatic group (for example, an alkyl group, a cycloalkyl group, an alkenyl group, etc.), an aromatic group (for example, a phenyl group, a naphthyl group, etc.), or a heterocyclic group (for example, a thiazolyl group, a benzothiazolyl group, an imidazolyl group, a thiazolinyl group, a pyridinyl group, a tetrazolyl group, etc.); $R^{22}$ represents a hydrogen atom, an aliphatic group as defined for $R^{21}$ or an aromatic group as defined for $R^{21}$; $R^{23}$ represents a hydrogen atom or an aliphatic group as defined for $R^{21}$; and $R^{11}$ has the same meaning as defined above, and at least one of $R^{22}$ and $R^{23}$ is a hydrogen atom. $R^{21}$ and $R^{23}$ may also be bonded together to form a ring. Preferred examples of the ring include the following:

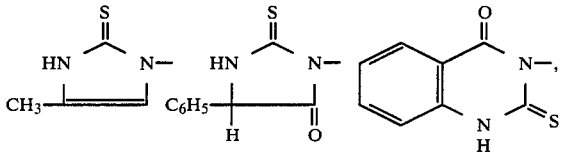

etc.

The group represented by $R^{21}$ or $R^{22}$ may be substituted with an alkoxy group, an alkoxycarbonyl group, an aryl group, an alkyl group, a dialkylamino group, an alkylthio group, a mercapto group, a hydroxy group, a halogen atom, a carboxy group, a nitro group, a cyano group, a sulfonyl group, a carbamoyl group, etc.

In the group represented by the formula

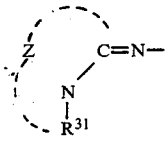

atoms forming together with

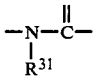

a 5-membered or 6-membered heterocyclic ring. Specific examples of the heterocyclic ring include, for example, a thiazoline ring, a benzothiazoline ring, a naphthothiazoline ring, a thiazolidine ring, an oxazoline ring, a benzoxazoline ring, an oxazolidine ring, a selenazoline ring, a benzoselenazoline ring, an imidazoline ring; a benzimidazoline ring, a tetrazoline ring, a triazoline ring, a thiadiazoline ring, a 1,2-dihydropyridine ring, a 1,2-dihydroquinoline ring, a 1,2,3,4-tetrahydroquinoline ring, a perhydro-1,3-oxazine ring, a 2,4-benz[d]oxazine ring, a perhydro-1,3-thiazine ring, a 2,4-benz[d]thiazine ring, a uracil ring, etc.

$R^{31}$ represents a hydrogen atom or a saturated or unsaturated aliphatic group (for example, an alkyl group, an alkenyl group, an alkynyl group, etc.) which may be substituted with an alkoxy group, an alkylthio group, an acylamino group, an acyloxy group, a mercapto group, a sulfo group, a carboxy group, a hydroxy group, a halogen atom, an amino group, etc.

Of the above-described groups represented by X, particularly preferred groups are groups containing a $$-\underset{\underset{S}{\|}}{C}-NH-$$

unit, the group represented by $$R^{21}-NH-\underset{\underset{O}{\|}}{C}-NH-$$

and the group represented by the formula

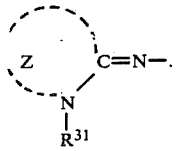

In the general formula (I), the alkyl group which may be substituted represented by $R^1$ is an alkyl group containing 1 to 10 carbon atoms and which is substituted with a substituent as defined for the aryl group described above.

$R^1$ in the general formula (I) is more preferably an aryl group which may be substituted than an alkyl group which may be substituted.

In the general formula (I), the aryl group which may be substituted represented by $R^2$ includes a mono- or dicyclic aryl group, for example, a group containing a benzene ring or a naphthalene ring. A benzene ring is particularly preferred. The aryl group may be substituted with a substituent, for example, a halogen atom, a cyano group, a carboxy group, a sulfo group, etc. Preferred examples of the aryl group represented by $R^2$ include a phenyl group, a 4-chlorophenyl group, a 4-bromophenyl group, a 3-chlorophenyl group, a 4-cyanophenyl group, a 4-carboxyphenyl group, a 4-sulfophenyl group, a 3,5-dichlorophenyl group, a 2,5-dichlorophenyl group, etc.

In the general formula (I), the alkyl group which may be substituted represented by $R^2$ is preferably an alkyl group containing from 1 to 4 carbon atoms, which may be substituted with a substituent, for example, a halogen atom, a cyano group, a carboxy group, a sulfo group, etc. Examples of particularly preferred alkyl groups include a methyl group, an ethyl group, an n-propyl group, an isopropyl group, etc.

Of the compounds represented by the general formula (I), those described in Japanese Patent Application (OPI) Nos. 10921/78, 20922/78 and 66732/78, U.S. Pat. Nos. 4,031,127, 4,030,925, 4,243,739 and 4,272,614, *Research Disclosure,* 17626 (1978, No. 176), etc., are preferred. Particularly preferred compounds are those described in Japanese Patent Application (OPI) Nos. 10921/78, 20922/78 and 66732/78.

Of the compounds represented by the general formula (I) according to the present invention, compounds represented by the following general formula (II) are particularly preferred.

$$R^1-\underset{\underset{R^2}{|}}{N}-\overset{\overset{O}{\|}}{C}-\underset{\underset{R^3}{|}}{N}-X-NHNH-\underset{\underset{O}{\|}}{C}-R^4 \qquad \text{(II)}$$

Wherein $R^1$ and $R^2$ (which may be the same or different) each represents a hydrogen atom, an aliphatic group, an aromatic group or a heterocyclic group; $R^3$ represents a hydrogen atom or an aliphatic group; $R^4$ represents a hydrogen atom, an aliphatic group or an aromatic group; and X represents a divalent aromatic group.

The compounds represented by the general formula (II) are more particularly explained below.

The aliphatic groups represented by $R^1$, $R^2$, and $R^4$ of the general formula (II) includes a straight chain or branched chain alkyl group, a cycloalkyl group, including those having substituents, an alkenyl group, and an alkynyl group. Examples of the straight chain or branched chain alkyl groups for $R^1$ and $R^2$ include alkyl groups having from 1 to 18, and preferably from 1 to 8, carbon atoms. Specific examples include a methyl group, an ethyl group, an isobutyl group, a t-octyl group, etc. Examples of the straight chain or branched chain alkyl group for $R^4$ include alkyl groups having from 1 to 10 carbon atoms. Specific examples include a methyl group, an ethyl group, a propyl group, etc.

Examples of the cycloalkyl groups for $R^1$, $R^2$, and $R^4$ include cycloalkyl groups having from 3 to 10 carbon atoms. Specific examples include a cyclopropyl group, a cyclohexyl group, an adamantyl group, etc.

Examples of the substituents for the alkyl group or the cycloalkyl group include an alkoxy group (e.g., a methoxy group, an ethoxy group, a propoxy group, a butoxy group, etc.), an alkoxycarbonyl group, a carbamoyl group, a hydroxy group, an alkylthio group, an amido group, an acyloxy group, a cyano group, a sulfonyl group, a halogen atom (e.g., a chlorine atom, a bromine atom, a fluorine atom, an iodine atom, etc.), an aryl group (e.g., a phenyl group, a halogen-substituted phenyl group, an alkyl-substituted phenyl group, etc.), etc. Specific examples of substituted alkyl groups and substituted cycloalkyl groups include a 3-methoxypropyl group, an ethoxycarbonylmethyl group, a 4-chlorocyclohexyl group, a benzyl group, a p-methylbenzyl group, a p-chlorobenzyl group, etc.

Examples of the alkenyl group include an allyl group, etc., and examples of the alkynyl group include a propargyl group, etc.

On the other hand, examples of the aromatic groups represented by $R^1$ and $R^2$ and $R^4$ include a phenyl group, a naphthyl group, including those having substituents (e.g., an alkyl group, an alkoxy group, an acylhydrazino group, a dialkylamino group, an alkoxycarbonyl group, a cyano group, a carboxy group, a nitro group, an alkylthio group, a hydroxy group, a sulfonyl group, a carbamoyl group, a halogen atom, an acylamino group, a sulfonamido group, a thioureido group, etc.). Specific examples of the substituted groups include, for example, a p-methoxyphenyl group, an o-methoxyphenyl group, a tolyl group, a p-formylhydrazinophenyl group, a p-chlorophenyl group, an m-fluorophenyl group, an m-benzamidophenyl group, an m-acetamidophenyl group, an m-benzenesulfonamidophenyl group, an m-phenylthioureidophenyl group, etc.

The heterocyclic groups represented by $R^1$ and $R^2$ include a 5-membered or 6-membered single ring, or a condensed ring, having at least one hetero atom selected from oxygen, nitrogen, sulfur, and selenium atoms, and these heterocyclic groups may have substituents. Specific examples of the heterocyclic groups include a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring, a naphthoselenazole ring, etc.

These heterocyclic ring groups may be substituted by an alkyl group having from 1 to 4 carbon atoms, such as a methyl group, an ethyl group, etc.; an alkoxy group having from 1 to 4 carbon atoms, such as a methoxy group, an ethoxy group, etc.; an aryl group having from 6 to 18 carbon atoms, such as a phenyl group, etc.; a halogen atom such as a chlorine atom, a bromine atom, etc.; an alkoxycarbonyl group, a cyano group, an amido group, etc.

It is preferred that one of $R^1$ and $R^2$ be a hydrogen atom. It is also preferred that $R^4$ be a hydrogen atom or a methyl group, and particularly a hydrogen atom.

The aliphatic group represented by $R^3$ includes a straight chain or branched chain alkyl group, a cycloalkyl group, including those having substituents, an alkenyl group, and an alkynyl group. The straight chain or branched chain alkyl group is generally an alkyl group having from 1 to 18 carbon atoms, and preferably from 1 to 6 carbon atoms, and specific examples thereof include a methyl group, an ethyl group, an isopropyl group, etc. The cycloalkyl group is generally an cycloalkyl group having from 3 to 10 carbon atoms, and specific examples thereof include a cyclopentyl group, a cyclohexyl group, etc. Examples of the substituent include an alkoxy group (e.g., a methoxy group, an ethoxy group, etc.), an alkoxycarbonyl group, an aryl group (e.g., a phenyl group, a halogen-substituted phenyl group, an alkoxyphenyl group, an alkylphenyl group, etc.), an amido group, an acyloxy group, etc. Specific examples of such substituted groups include a 3-methoxypropyl group, a benzyl group, a p-chlorobenzyl group, a p-methoxybenzyl group, a p-methylbenzyl group, etc. Examples of the alkenyl group include alkenyl groups having from 3 to 12 carbon atoms, and preferably, for example, an allyl group, a 2-butenyl group, etc.

$R^3$ is preferably a hydrogen atom.

X represents a divalent aromatic group and specific examples thereof include, for example, a phenylene group, a naphthylene group (e.g., a 1,2-naphthylene group, a 1,4-naphthylene group, a 2,3-naphthylene group, a 1,5-naphthylene group, and a 1,8-naphthylene group), and substituted groups thereof.

Examples of the substituents for the divalent aromatic groups include, for example, an alkyl group having from 1 to 20 carbon atoms (which may be branched), an aralkyl group the alkyl moiety of which has from 1 to 3 carbon atoms, an alkoxy group (having preferably from 1 to 20 carbon atoms), a substituted alkoxy group (preferably having from 1 to 20 carbon atoms), a mono- or di-substituted amino group substituted with one or two alkyl groups or substituted alkyl groups (each having from 1 to 20 carbon atoms), an aliphatic acylamino group (having preferably from 2 to 21 carbon atoms), an aromatic acylamino group, an alkylthio group, a hydroxy group, a halogen atom (e.g., a chlorine atom, etc.), and so forth.

X is preferably a phenylene group.

Preferred compounds among the compounds represented by the general formula (II) are those represented by the following general formula (III)

$$R^1-NHC(=O)NH-X-NHNHCHO \quad \text{(III)}$$

wherein $R^1$ and X have the same meanings as defined in formula (II) above.

Specific examples of the useful fogging agents represented by the general formula (I) according to the present invention are set forth below, but the present invention is not to be construed as being limited thereto.

I-1

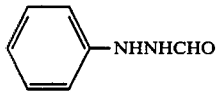

I-2

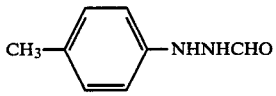

I-3

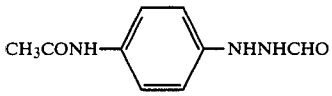

I-4

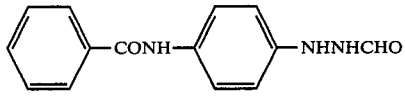

I-5

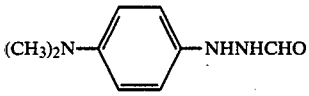

I-6

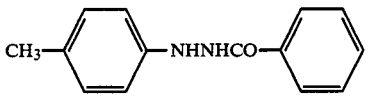

I-7

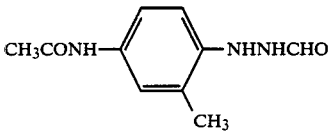

I-8

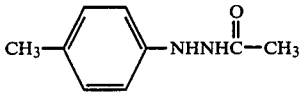

-continued
I-9
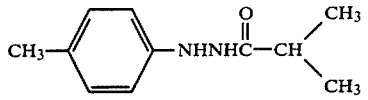
I-10
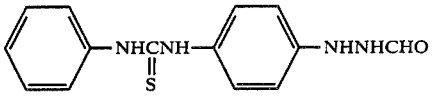
I-11
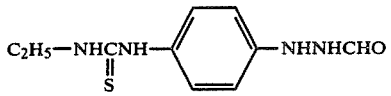
I-12
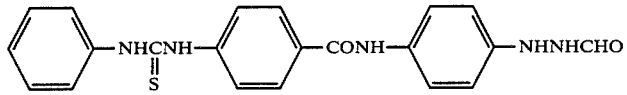
I-13
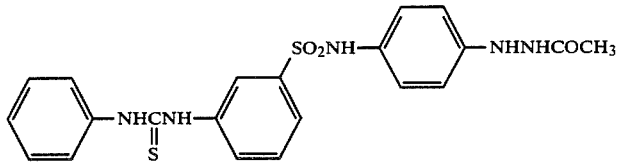
I-14
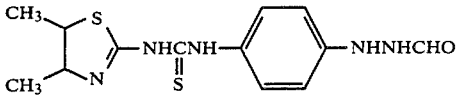
I-15
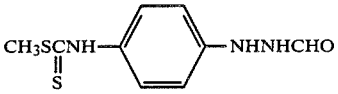
I-16
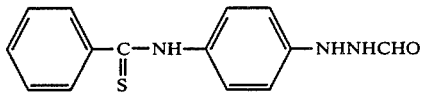
I-17
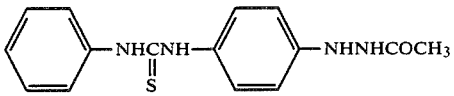
I-18
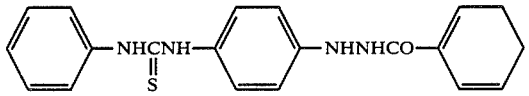
I-19
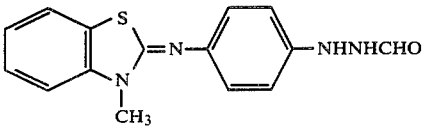
I-20
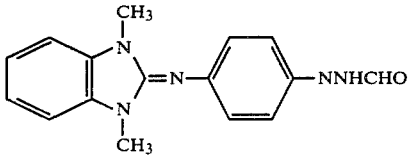
I-21
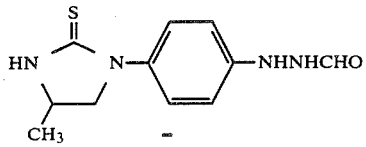
I-22
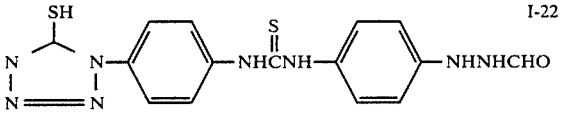
I-23
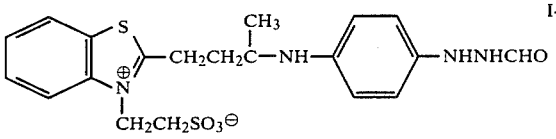
I-24
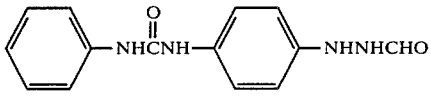
I-25
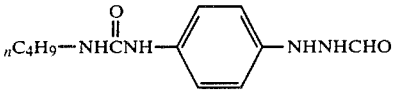
I-26
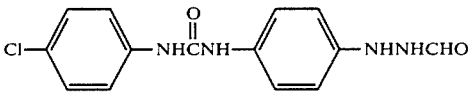

-continued
I-27
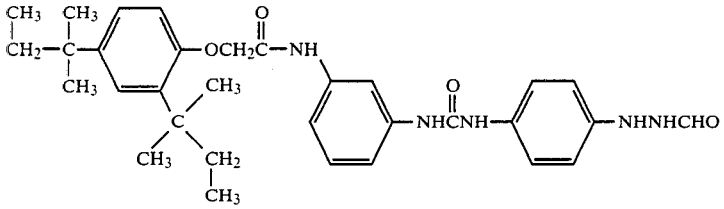
I-28
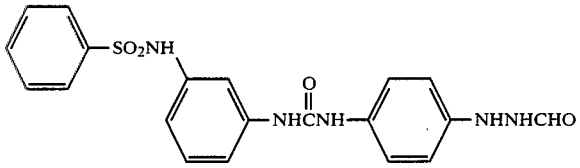
I-29
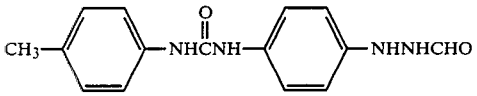
I-30
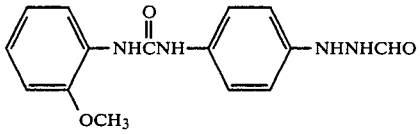
I-31
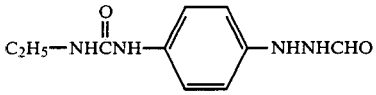
I-32
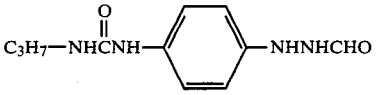
I-33
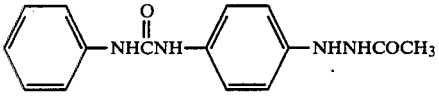
I-34
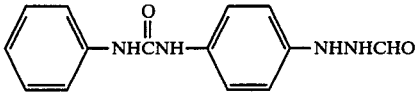
I-35
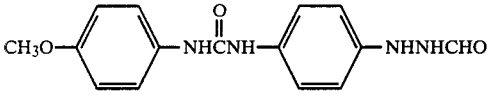
I-36
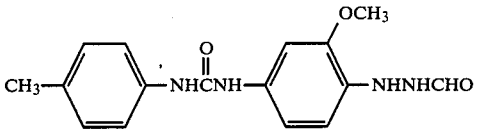
I-37
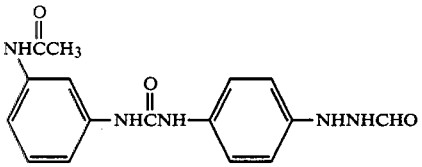
I-38
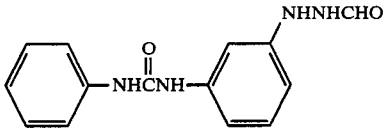
I-39
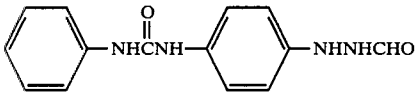
I-40
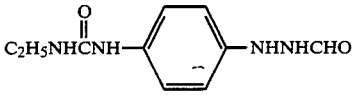
I-41
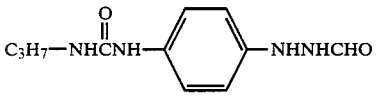
I-42
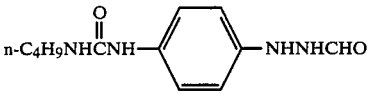
I-43
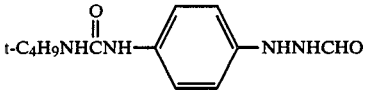
I-44
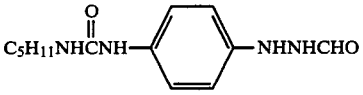
I-45
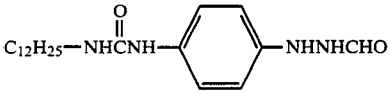
I-46
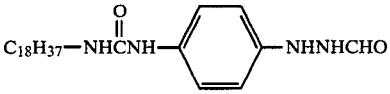

-continued

I-47

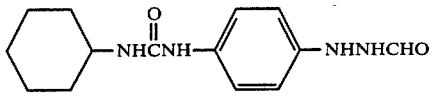

I-48

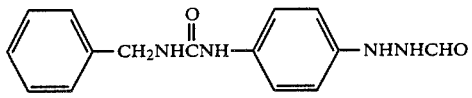

I-49

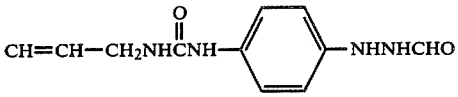

I-50

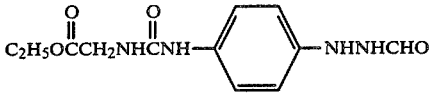

I-51

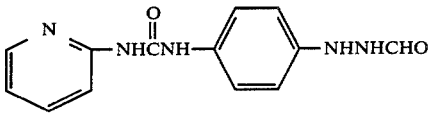

I-52

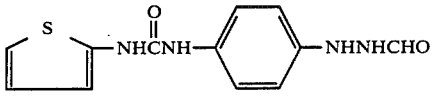

I-53

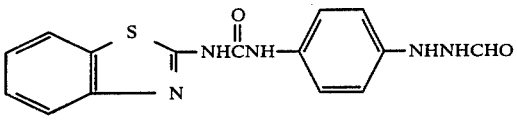

I-54

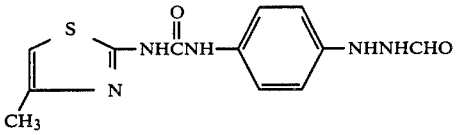

I-55

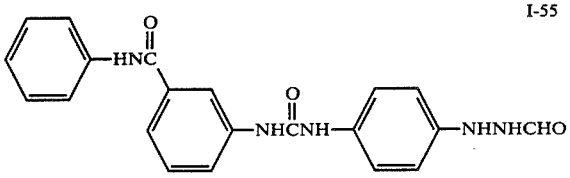

I-56

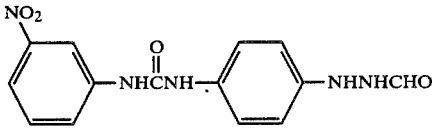

I-57

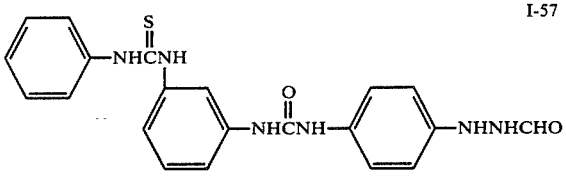

I-58

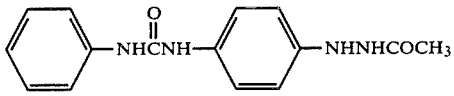

I-59

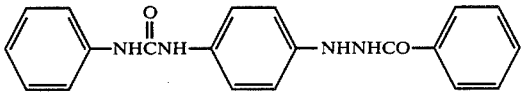

I-60

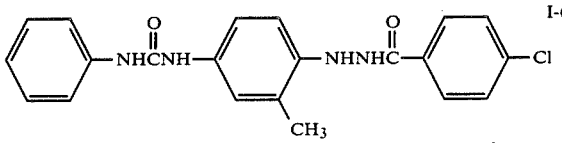

I-61

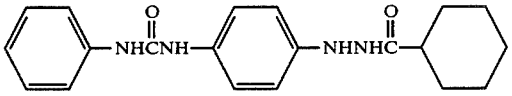

Of the above described specific compounds, Compound I-26 to Compound I-61 are more preferred.

In the direct positive photographic light-sensitive material according to the present invention, it is preferred that the compound represented by formula (I) be incorporated into an internal latent image type silver halide emulsion layer. However, the compound can also be incorporated into a hydrophilic colloid layer adjacent to an internal latent image type silver halide emulsion layer. Such a layer can be any layer of a light-sensitive layer, an intermediate layer, a filter layer, a protective layer, an antihalation layer, etc., having any function, as long as the fogging agent is not prevented from diffusing into the internal latent image type silver halide emulsion layer.

It is desired that the fogging agent according to the present invention in the layer(s) be present in an amount that results in a suitable maximum density (for example, above 1.70) when the internal latent image type emulsion is developed by a surface developing solution. For practical purposes, the appropriate content can vary over a wide range, depending upon the characteristics of silver halide emulsion, the chemical structure of the fogging agent and the developing conditions. Nevertheless, a range of from about 0.1 mg to 5,000 mg per mol of silver halide in the internal latent image type silver halide emulsion is generally effective, more preferably is from about 0.5 mg to about 2,000 mg per mol of silver halide, and most preferably is from about 1 mg to about 1,000 mg per mol of silver halide. Where the fogging agent is incorporated into the hydrophilic colloid layer adjacent to the emulsion layer, it is adequate to incorporate the fogging agent in the above amount, based on consideration of the amount of silver contained in the associated internal latent image type emulsion layer.

Internal latent image type silver halide emulsions are described by Davey et al, U.S. Pat. No. 2,592,250 (incorporated herein by reference to disclose such emulsion) and are also described in other references. The internal latent image type silver halide emulsion can be clearly defined by the fact that the maximum density achieved in the case of developing it with an "internal type" developing solution is greater than the maximum density achieved in the case of developing it with a "surface type" developing solution. The internal latent image type emulsion which is suitable for the present invention has a maximum density (measured by an ordinary photographic density measurement method), when coated onto a transparent support and exposed to light for a fixed time period of between 0.01 to 1 second and then developed with Developing Solution A indicated below (an internal type developing solution) at 20° C. for 3 minutes, which is greater, by at least 5 times, than the maximum density obtained in the case of developing the silver halide emulsion exposed as described above with Developing Solution B indicated below (a surface type developing solution) at 20° C. for 4 minutes.

| | |
|---|---|
| Developing Solution A: | |
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 l |
| Developing Solution: | |
| p-Oxyphenylglycin | 10 g |
| Sodium Carbonate | 100 g |
| Water to make | 1 l |

Internal latent image type emulsions which are suitable for the objects of the present invention include the emulsions described in Japanese Patent Publication No. 34213/77, British Pat. No. 1,027,146, U.S. Pat. Nos. 3,206,313, 3,511,662, 3,447,927, 3,737,313, 3,761,276 and 3,271,157. A useful emulsion is also described in U.S. Pat. No. 2,592,250 referred to above. However, the silver halide emulsions used in the present invention are not limited to these.

The direct positive photographic light-sensitive material of the present invention can include a variety of hydrophilic colloids as the binder.

Useful colloids include hydrophilic colloids conventionally employed in the photographic field, such as gelatin, colloidal albumin, polysaccharides, cellulose derivatives, synthetic resins, for example, polyvinyl compounds, including, e.g., polyvinyl alcohol derivatives, acrylamide polymers, etc. Hydrophobic colloids, e.g., dispersed polymerized vinyl compounds, particularly those that increase dimensional stability of photographic materials, can also be incorporated together with the hydrophilic colloid. Suitable examples of this type of compounds include water-insoluble polymers prepared by polymerizing vinyl monomers such as alkyl acrylates, alkyl methacrylates, acrylic acid, sulfoalkyl acrylates, sulfoalkyl methacrylates, and so forth.

Various compounds can be added to the photographic emulsion described above in order to prevent the reduction in sensitivity or fog formation during production, storage, or processing of the photographic light-sensitive material. A great many compounds have been known for these purposes, and they include 4-hydroxy-6-methyl-1,3,3a,7-tetraazaindene, 3-methylbenzothiazole, 1-phenyl-5-mercaptotetrazole, various heterocyclic compounds, mercury containing compounds, mercapto compounds, metal salts, etc. Some specific examples of such compounds are mentioned in K. Mees, *The Theory of the Photographic Process,* 3rd ed. 1966 by reference to the papers which first reported such compounds, and in addition, are described in U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339, British Pat. Nos. 893,428, 403,789, 1,173,609 and 1,200,188, etc.

A variety of photographic supports can be employed in the photographic light-sensitive material of the present invention. The silver halide emulsion can be coated onto one side or both sides of the support.

In the photographic light-sensitive material according to the present invention, the photographic silver halide emulsion layers and other hydrophilic colloid layers can be hardened with an appropriate hardening agent. Examples of these hardening agents include vinylsulfonyl compounds, as described in Japanese Patent Application Nos. 151636/76, 151641/76 and 154494/76, hardening agents having active halogen, dioxane derivatives, oxypolysaccharides such as oxy starch, and so forth.

The photographic silver halide emulsion layer can contain other additives, particularly those useful for photographic emulsions, e.g., lubricants, sensitizers, light absorbing dyes, plasticizers, etc.

In addition, in the present invention compounds which release iodine ions (such as potassium iodide) can be incorporated into the silver halide emulsion and, furthermore, the desired image can be obtained using a developing solution containing iodine ions.

The photographic light-sensitive material according to the present invention may contain a water-soluble dye in the hydrophilic colloid layer as a filter dye or for other various purposes like prevention of irradiation or anti-halation. Such dyes include oxonol dyes, hemioxonol dyes, styryl dyes, merocyanine dyes, cyanine dyes, and azo dyes. Of these, oxonol dyes, hemioxonol dyes, and merocyanine dyes are useful.

In the photographic light-sensitive material according to the present invention, when the hydrophilic colloid layer contains a dye or an ultraviolet ray absorbing agent, etc., these compounds may be mordanted with a cationic polymer, etc. For instance, polymers described in British Pat. Nos. 1,468,460 and 685,475, U.S. Pat. Nos. 2,675,316, 2,839,401, 2,882,156, 3,048,487, 3,184,309, 3,445,231 and 3,986,875, West German Patent Application (OLS) No. 1,914,362, etc. can be used.

The photographic light-sensitive material according to the present invention can contain surface active agents for a variety of purposes. Depending upon the purpose, any one of nonionic, ionic and amphoteric surface active agents can be employed, which are examplified by, e.g., polyoxyalkylene derivatives, amphoteric amino acids (including sulfobetaines), etc. Examples of such surface active agents are described in U.S. Pat. Nos. 2,600,831, 2,271,622, 2,271,623, 2,275,727, 2,787,604, 2,816,920 and 2,739,391, Belgian Pat. No. 652,862, etc.

In the photographic light-sensitive material according to the present invention, the photographic emulsion can be spectrally sensitized with sensitizing dyes to blue light of relatively long wavelengths, to green light, to red light, to infrared light. As sensitizing dyes, cyanine dyes, merocyanine dyes, complex cyanine dyes, complex merocyanine dyes, holopolar cyanine dyes, styryl dyes, hemicyanine dyes, oxonol dyes, hemioxonol dyes, etc., can be employed.

Useful sensitizing dyes which can be employed in accordance with the present invention are described, for example, in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, British Pat. No. 1,404,511, Belgian Pat. No. 691,807, etc.

The sensitizing dyes employed in the present invention are used in a concentration almost equivalent to that used in ordinary negative silver halide emulsions. In particular, it is advantageous that the sensitizing dyes be employed in a dye concentration to a degree that does not substantially cause desensitization in the region of intrinsic sensitivity of the silver halide emulsion. It is preferred that the sensitizing dyes be employed in a concentration of from about $1.0\times10^{-5}$ to about $5\times10^{-4}$ mol per mol of silver halide, and particularly in concentration of from about $4\times10^{-5}$ to $2\times10^{-4}$ mol per mol of silver halide.

To an emulsion layer of a protective layer of the direct positive photographic light-sensitive material according to the present invention, there may be added a matting agent and/or a lubricant, etc. Preferred specific examples of the matting agent employed include organic compounds, for example, water dispersible vinyl polymers such as polymethyl methacrylate having an appropriate particle size (particularly from 0.3 to 5 microns), etc. or inorganic compounds, for example, silver halide, strontium barium sulfate, etc. The lubricant is useful for preventing blocking troubles. The lubricants are particularly effective for improvement of friction properties with respect to the adaptability of cinematographic films to a camera during photographing and to a projector during projection. Preferred specific examples of the lubricant employed include liquid paraffin, waxes such as esters of higher fatty acids, polyfluorinated hydrocarbons or derivatives thereof, silicones such as polyalkylpolysiloxanes, polyarylpolysiloxanes, polyalkylarylpolysiloxanes or alkyleneoxide addition derivatives thereof, etc.

The photographic light-sensitive material according to the present invention can contain various auxiliary layers, such as a protective layer, an intermediate layer, a filter layer, an anti-halation layer, and the like.

In the processing method of the present invention, any known methods can be employed. Specifically, it includes basically a development step and a fixing step. A stopping step and a water washing step can be further included, if desired. The processing temperature is usually selected within the range of from 18° C. to 50° C. However, temperatures lower than 18° C. and temperatures higher than 50° C. can be employed, if desired.

In the developing solution used in the processing method of the present invention, a hydroquinone alone, a combination of a hydroquinone and a 3-pyrazolidone, for example, 1-phenyl-3-pyrazolidone, 4,4-dimethyl-1-phenyl-3-pyrazolidone, etc., or a combination of a hydroquinone and an aminophenol, for example, N-methyl-p-aminophenol, 2,4-diaminophenol, etc. can be used as a developing agent. Specific examples of the hydroquinones include hydroquinone, methylhydroquinone, chlorohydroquinone, t-butylhydroquinone, bromohydroquinone, etc. The amount of the hydroquinone used is not less than 25 g per liter, preferably from 25 g per liter to 70 g per liter, and more preferably from 30 g per liter to 65 g per liter.

The developing solution can contain, as a preservative, a sulfite, etc. The amount of the preservative used is preferably from 0.2 mol per liter to 2 mol per liter and particularly from 0.4 mol per liter to 1.8 mol per liter.

The developing solution can contain, as an alkali agent and a buffering agent, sodium hydroxide, potassium hydroxide, sodium carbonate, potassium carbonate, trisodium phosphate, sodium metaborate, etc. The amount of these agents used is elected so as to result in a pH of the developing solution of from 11 to 13, and preferably a pH of from 11 to 12.5.

It is advantageous that the developing solution further contains, in order to lessen the minimum density of direct positive images, a compound which is usually employed as an anti-fogging agent, for example, a benzimidazole, for example, 5-nitrobenzimidazole; a benzotriazole, for example, benzotriazole, 5-methylbenzotriazole, etc.

Furthermore, the developing agent may contain a dissolving aid, a toning agent, a development accelerator, a surface active agent, a defoaming agent, a water softener, a hardening agent, a viscosity-imparting agent, or the like, if desired.

Conventional fixing solutions can be used. Examples of useful fixing agents include organic sulfur compounds which are known to function as fixing agents, as well as a thiosulfate, a thiocyanate, etc. The fixing solution may contain a water-soluble aluminium salt as a hardening agent.

The stopping solution may be an aqueous solution having a low pH. An aqueous solution having a pH of not more than 3.5 with acetic acid or sulfuric acid, etc. and containing a buffering agent is preferred.

The present invention will be explained in greater detail by reference to the following examples. However, the present invention should not be construed as being limited thereto.

EXAMPLE 1

Developing solutions having the compositions shown below were prepared. In order to determine the pH buffering function of these solutions, an amount of a 30% acetic acid necessary to reduce a pH from 11.50 to 11.00, a pH from 11.00 to 10.50 or a pH from 10.50 to 10.00 was measured. The results thus obtained are shown in Table 1 below.

TABLE 1

| | | Developing Solution No. | | | | | | | | |
|---|---|---|---|---|---|---|---|---|---|---|
| | | 1 | 2 | 3 | 4 | 5 | 6 | 7 | 8 | 9 |
| Composition | | | | | | | | | | |
| $Na_2CO_3$ $H_2O$ | (g/l) | 0 | 0 | 80 | — | 40 | 40 | 40 | 40 | 40 |

TABLE 1-continued

| | | Developing Solution No. | | | | | | | | |
|---|---|---|---|---|---|---|---|---|---|---|
| | | 1 | 2 | 3 | 4 | 5 | 6 | 7 | 8 | 9 |
| $Na_3PO_4$ $12H_2O$ | (g/l) | 0 | 0 | — | 80 | — | — | — | — | — |
| $Na_2SO_3$ | (g/l) | 100 | 100 | 100 | 100 | 100 | 100 | 100 | 100 | 100 |
| Na Br | (g/l) | 3 | 3 | 3 | 3 | 3 | 3 | 3 | 3 | 3 |
| Hydroquinone | (g/l) | 0 | 20 | 0 | 0 | 20 | 25 | 30 | 40 | 50 |
| 3-Pyrazolidone | (g/l) | 3 | 3 | 3 | 3 | 3 | 3 | 3 | 3 | 3 |
| 5-Methylbenzotriazole | (mg/l) | 100 | 100 | 100 | 100 | 100 | 100 | 100 | 100 | 100 |
| pH (adjusted with NaOH) | | 11.50 | 11.50 | 11.50 | 11.50 | 11.50 | 11.50 | 11.50 | 11.50 | 11.50 |
| Acetic Acid (30%) necessary to reduce a pH 0.5 | | | | | | | | | | |
| pH 11.50 → 11.00 | | 5 | 11 | 5 | 5 | 11 | 22 | 25 | 30 | 35 |
| pH 11.00 → 10.50 | | 5 | 11 | 5 | 5 | 12 | 22 | 25 | 30 | 35 |
| pH 10.50 → 10.00 | | 5 | 11 | 6 | 5 | 18 | 22 | 25 | 30 | 35 |

It is apparent from the results shown in Table 1 above that hydroquinone has a remarkably great buffering function in comparison with sodium carbonate or trisodium phosphate and particularly hydroquinone has an excellent buffering function at a pH not less than 11.0.

Further, 1 liter of each of fresh Developing Solutions 5, 6, 7, 8 and 9 was put into a 1 liter beaker and allowed to stand in an open condition at room temperature for 5 days. Then the remaining amount of hydroquinone was determined. The results thus obtained are shown in Table 2 below.

TABLE 2

| Developing Solution No. | Amount of Hydroquinone (Recipe Value) (g/l) | Remaining Amount of Hydroquinone (g/l) | Remaining Rate (%) |
|---|---|---|---|
| 5 | 20 | 7 | 35 |
| 6 | 25 | 13.8 | 55 |
| 7 | 30 | 22.5 | 75 |
| 8 | 40 | 34 | 85 |
| 9 | 50 | 45 | 90 |

From the results shown in Table 2 above it is apparent that the remaining rate of hydroquinone is low such as 35% when the amount of hydroquinone added is in a range of 20 g/l, but the rate is remarkably improved when the amount of addition is 25 g/l or more.

According to the method for preparation of Emulsion A in Example 1 of Japanese Patent Publication No. 34213/77 (U.S. Pat. No. 3,761,276), an internal latent image type direct positive emulsion comprising octahedral silver bromide grains having an average side length of 0.8 microns was prepared. The surfaces of the silver bromide grains of this emulsion was chemically sensitized with sodium thiosulfate. The emulsion was divided into 5 portions, and to each portion, a fogging agent was added, as shown in Table 3 below, and coated on a polyethylene terephthalate support, with the silver coated in an amount of 3.0 g/m$^2$. On this emulsion layer, a gelatin protective layer was further coated, to prepare Samples 1 to 5.

Samples 1 to 5 were exposed through a stepwedge with a tungsten lamp having a color temperature of 2854° K. and 2 KW for 1 second and developed at 35° C. for 1 minute using fresh Developing Solutions 5, 6, 7 and 9 and Developing Solutions 5, 6, 7 and 9 which had been aged for 5 days at room temperature, and were then stopped, fixed, and washed with water in a conventional manner.

| Fixing Solution | |
|---|---|
| Ammonium Thiosulfate | 100 g |

-continued

| Fixing Solution | |
|---|---|
| Sodium Sulfite | 20 g |
| Water to make | 1 liter (pH: 6.0) |

Maximum optical density (D max) and minimum optical density (D min) were measured with Samples 1 to 5 thus processed using a densitometer. The results obtained are shown in Table 3 below. As is apparent from the results shown in Table 3, when development is carried out using a developing solution having a pH of 11.50 and containing not less than 25 g per liter of hydroquinone no matter how aged it is, excellent results without substantial decrease in D max are obtained.

TABLE 3

| Sample No. | Fogging Agent | Amount Added | Developing Solution | Fresh Developing Solution D max | Fresh Developing Solution D min | Aged Developing Solution D max | Aged Developing Solution D min |
|---|---|---|---|---|---|---|---|
| 1 | I-2 | 100 mg/mol of Ag | 5 | 0.70 | 0.08 | 0.30 | 0.08 |
| | | | 6 | 0.70 | 0.08 | 0.70 | 0.08 |
| | | | 7 | 0.70 | 0.08 | 0.70 | 0.08 |
| | | | 9 | 0.70 | 0.08 | 0.70 | 0.08 |
| 2 | I-10 | 10 mg/mol of Ag | 5 | 0.80 | 0.13 | 0.40 | 0.10 |
| | | | 6 | 0.80 | 0.13 | 0.70 | 0.10 |
| | | | 7 | 0.80 | 0.13 | 0.70 | 0.10 |
| | | | 9 | 0.80 | 0.13 | 0.70 | 0.10 |
| 3 | I-24 | 100 mg/mol of Ag | 5 | 1.70 | 0.08 | 1.05 | 0.08 |
| | | | 6 | 1.70 | 0.08 | 1.70 | 0.08 |
| | | | 7 | 1.70 | 0.08 | 1.70 | 0.08 |
| | | | 9 | 1.70 | 0.08 | 1.70 | 0.08 |
| 4 | I-27 | 45 mg/mol of Ag | 5 | 1.70 | 0.08 | 0.50 | 0.08 |
| | | | 6 | 1.70 | 0.08 | 1.70 | 0.08 |
| | | | 7 | 1.70 | 0.08 | 1.70 | 0.08 |
| | | | 9 | 1.70 | 0.08 | 1.70 | 0.08 |
| 5 | I-30 | 100 mg/mol of Ag | 5 | 1.70 | 0.08 | 1.10 | 0.08 |
| | | | 6 | 1.70 | 0.08 | 1.70 | 0.08 |
| | | | 7 | 1.70 | 0.08 | 1.70 | 0.08 |
| | | | 9 | 1.70 | 0.08 | 1.70 | 0.08 |

EXAMPLE 2

With Samples 1 to 5 prepared in Example 1, development processing was carried out using Developing Solution 6 in Example 1 with a variation of pH and the changes in D max and D min were determined. The results thus obtained are shown in Table 4 below. As is apparent from the results shown in Table 4 when the pH of the developing solution is adjusted to not less than 11.0 a sufficient D max and an excellent positive image is obtained.

TABLE 4

| Sample No. | pH | Fresh Developing Solution D max | D min |
|---|---|---|---|
| 1 | 12.0 | 0.72 | 0.08 |
| | 11.5 | 0.70 | 0.08 |
| | 11.0 | 0.60 | 0.08 |
| | 10.5 | 0.08 | 0.08 |
| 2 | 12.0 | 0.85 | 0.14 |
| | 11.5 | 0.80 | 0.13 |
| | 11.0 | 0.70 | 0.12 |
| | 10.5 | 0.08 | 0.08 |
| 3 | 12.0 | 1.75 | 0.08 |
| | 11.5 | 1.70 | 0.08 |
| | 11.0 | 1.60 | 0.08 |
| | 10.5 | 0.08 | 0.08 |
| 4 | 12.0 | 1.72 | 0.08 |
| | 11.5 | 1.70 | 0.08 |
| | 11.0 | 1.60 | 0.08 |
| | 10.5 | 0.08 | 0.08 |
| 5 | 12.0 | 1.76 | 0.08 |
| | 11.5 | 1.70 | 0.08 |
| | 11.0 | 1.65 | 0.08 |
| | 10.5 | 0.08 | 0.08 |

While the invention has been described in detail with reference to specific embodiments thereof, it will be apparent to one skilled in the art that various changes and modifications can be made therein without departing from the spirit and scope thereof.

What is claimed is:

1. A method of processing a direct positive silver halide light-sensitive material which contains an internal latent image type silver halide emulsion layer, comprising the steps of:

providing a direct positive silver halide photographic light-sensitive material comprising a support having coated thereon a hydrophilic colloid layer containing a fogging compound represented by the following general formula (I):

$$R^1NHNHCOR^2 \quad (I)$$

wherein $R^1$ represents an unsubstituted or substituted aryl group or an unsubstituted or substituted alkyl group; and $R^2$ represents a hydrogen atom, an unsubstituted or substituted aryl group or an unsubstituted or substituted alkyl group;

imagewise exposing the material to light;

developing the exposed material in a developing solution containng 25 g/l or more of hydroquinone, the developing solution having a pH of from 11.0 to 13.0.

2. A method of processing a direct positive silver halide photographic light-sensitive material as claimed in claim 1, wherein the aryl group which may be substituted represented by $R^1$ is a mono- or dicyclic aryl group.

3. A method of processing a direct positive silver halide photographic light-sensitive material as claimed in claim 1, wherein $R^1$ represents an unsubstituted or substituted phenyl group.

4. A method of processing a direct positive silver halide photographic light-sensitive material as claimed in claim 2, wherein the substituent for the substituted aryl group is an alkyl group, an aralkyl group, an alkoxy group, a substituted amino group, an aliphatic acylamino group or an aromatic acylamino group.

5. A method of processing a direct positive silver halide photographic light-sensitive material as claimed in claim 1, wherein the substituent for the substituted aryl group is a group represented by the formula $X\text{-}(Y)_n$, wherein n represents 0 or 1; Y represents a divalent connecting group; and X represents a group containing a $$-\underset{\underset{S}{\|}}{C}-NH-$$

unit, a group containing a $$-\underset{\underset{O}{\|}}{C}-NH-$$

unit, a group represented by

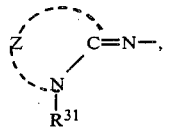

a heterocyclic group, an aralkyl group when n is 1, a substituted aryl group or a group represented by $$R^2-\underset{\underset{O}{\|}}{C}-NHNH-.$$

6. A method of processing a direct positive silver photographic light-sensitive material as claimed in claim 5, wherein the divalent connecting group represented by Y is —CONH—, $-R^{11}-CONH-$, $-O-R^{11}-CONH-$, $-S-R^{11}-CONH-$, $-R^{11}-$, $-R^{11}-O-R^{12}-$, $-R^{11}-S-R^{12}-$, $-SO_2NH-$, $-R^{11}-SO_2NH-$, —NHCONH—, $-CH_2-CH=N-$, $-R^{11}-NH-$, $-R^{11}-O-R^{12}-CONH-$, $-NHCO-R^{11}-$, $-NHCO-R^{11}-CONH-$ or $-R^{11}-R^{12}-$, wherein $R^{11}$ and $R^{12}$ (which may be the same or different) each represents a divalent saturated or unsaturated aliphatic group or a divalent aromatic group, and in $-R^{11}-R^{12}-$, $R^{11}$ and $R^{12}$ are different divalent groups.

7. A method of processing a direct positive silver halide photographic light-sensitive material as claimed in claim 5, wherein the heterocyclic group represented by X is a 5 membered or 6-membered ring containing at least one hetero atom.

8. A method of processing a direct positive silver halide photographic light-sensitive material as claimed in claim 5, wherein the aralkyl group represented by X is a mono- or dicyclic aralkyl group having an alkyl moiety containing from 1 to 3 carbon atoms.

9. A method of processing a direct positive silver halide photographic light-sensitive material as claimed in claim 5, wherein the substituent for the substituted aryl group represented by X is an alkyl group, an alkoxy group, a nitro group, a sulfonamido group or an acetamido group.

10. A method of processing a direct positive silver halide photographic light-sensitive material as claimed in claim 5, wherein the group containing a $$-\underset{\underset{S}{\|}}{C}-NH-$$

unit represented by X is an $$R^{21}-\underset{\underset{S}{\|}}{C}-NH-$$

group, an $$R^{21}-\underset{\underset{S}{\|}}{C}-NH-$$

group, an $$R^{21}-\underset{\underset{R^{22}}{|}}{N}-\underset{\underset{S}{\|}}{C}-\underset{\underset{R^{23}}{|}}{N}-$$

group or an $$R^{21}-R^{11}-NH-\underset{\underset{S}{\|}}{C}-NH-$$

group, wherein $R^{21}$ represents an aliphatic group, an aromatic group or a heterocyclic group; $R^{22}$ represents a hydrogen atom, $R^{23}$ represents a hydrogen atom or an aliphatic group; $R^{11}$ represents a divalent saturated or unsaturated aliphatic group or a divalent aromatic group; and $R^{21}$ and $R^{23}$ may be bonded together to form a ring.

11. A method of processing a direct positive silver halide photographic light-sensitive material as claimed in claim 5, wherein the group containing a $$-\underset{\underset{O}{\|}}{C}-NH-$$

unit represented by X is an $$R^{21}-\underset{\underset{O}{\|}}{C}-NH-$$

group or an $$R^{21}-\underset{\underset{R^{22}}{|}}{N}-\underset{\underset{O}{\|}}{C}-\underset{\underset{R^{23}}{|}}{N}-$$

group, wherein $R^{21}$ represents an aliphatic group, an aromatic group or a heterocyclic group; $R^{22}$ represents a hydrogen atom, an aliphatic group or an aromatic group; $R^{23}$ represents a hydrogen atom or an aliphatic group; and $R^{21}$ and $R^{23}$ may be bonded together to form a ring.

12. A method of processing a direct positive silver halide photographic light-sensitive material as claimed in claim 10 or 11 wherein the group represented by $R^{21}$ or $R^{22}$ may be substituted with an alkoxy group, an alkoxycarbonyl group, an aryl group, an alkyl group, a dialkylamino group, an alkylthio group, a mercapto group, a hydroxy group, a halogen atom, a carboxy group, a nitro group, a cyano group, a sulfonyl group or a carbamoyl group.

13. A method of processing a direct positive silver halide photographic light-sensitive material as claimed in claim 5, wherein Z represents a group of non-metallic atoms forming together with $$-\underset{\underset{R^{31}}{|}}{N}-\overset{\overset{\|}{}}{C}-$$

a 5-membered or 6-membered heterocyclic ring; and $R^{31}$ represents a hydrogen atom or a saturated or unsaturated aliphatic group.

14. A method of processing a direct positive silver halide photographic light-sensitive material as claimed in claim 5, wherein X represents a group containing a $$-\underset{\underset{S}{\|}}{C}-NH-$$

unit, a group represented by $$R^{21}-NH-\underset{\underset{O}{\|}}{C}-NH-$$

or a group represented

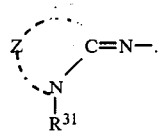

15. A method of processing a direct positive silver halide photographic light-sensitive material as claimed in claim 1, wherein the alkyl group which may be substituted represented by $R^1$ is an alkyl group containing from 1 to 10 carbon atoms.

16. A method of processing a direct positive silver halide photographic light-sensitive material as claimed in claim 15, wherein the substituent for the substituted alkyl group is an alkyl group, an aralkyl group, an alkoxy group, a substituted amino group, an aliphatic acylamino group or an aromatic acylamino group.

17. A method of processing a direct positive silver halide photographic light-sensitive material as claimed in claim 1, wherein the aryl group which may be substituted represented by $R^2$ is a mono- or dicyclic aryl group.

18. A method of processing a direct positive silver halide photographic light-sensitive material as claimed in claim 1, wherein $R^2$ represents an unsubstituted or substituted phenyl group.

19. A method of processing a direct positive silver halide photographic light-sensitive material as claimed in claim 17, wherein the substituent for the substituted aryl group is a halogen atom, a cyano group, a carboxy group or a sulfo group.

20. A method of processing a direct positive silver halide photographic light-sensitive material as claimed in claim 1, wherein the alkyl group which may be substituted represented by $R^2$ is an alkyl group containing 1 to 4 carbon atoms.

21. A method of processing a direct positive silver halide photographic light-sensitive material as claimed in claim 20, wherein the substituent for the substituted alkyl group is a halogen atom, a cyano group, a carboxy group or a sulfo group.

22. A method of processing a direct positive silver halide light-sensitive material which contains an internal latent image type silver halide emulsion layer, comprising the steps of:

providing a direct positive silver halide photographic light-sensitive material comprising a support having coated thereon a hydrophilic colloid layer containing a fogging compound represented by the following general formula (II):

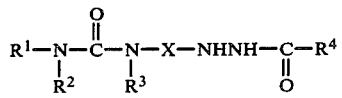

(II)

wherein $R^1$ and $R^2$ which may be the same or different each represents a hydrogen atom, an aliphatic group, an aromatic group, or a heterocyclic group; $R^3$ represents a hydrogen atom or an aliphatic group; $R^4$ represents a hydrogen atom, an aliphatic group, or an aromatic group; and X represents a divalent aromatic group;

imagewise exposing the material to light;

developing the exposed material in a developing solution containing 25 g/l or more of hydroquinone, the developing solution having a pH of from 11.0 to 13.0.

23. A method of processing a direct positive silver halide photographic light-sensitive material as claimed in claim 22, wherein the compound is represented by the following general formula (III)

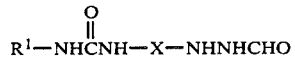

(III)

wherein $R^1$ represents a hydrogen atom, an aliphatic group, an aromatic group or a heterocyclic group; and X represents a divalent aromatic group.

24. A method of processing a direct positive silver halide photographic light-sensitive material as claimed in claim 1, wherein the compound is incorporated in an internal latent image type silver halide emulsion layer.

25. A method of processing a direct positive silver halide photographic light-sensitive material as claimed in claim 1, wherein the compound is incorporated into a hydrophilic colloid layer adjacent to an internal latent image type silver halide emulsion layer.

26. A method of processing a direct positive silver halide photographic light-sensitive material as claimed in claim 1, 24, or 25, wherein the amount of the compound is in a range of from 0.1 mg to 5,000 mg per mol of silver halide in the internal latent image type silver halide emulsion.

27. A method of processing a direct positive silver halide photographic light-sensitive material as claimed in claim 24 or 25, wherein the amount of the compound is in a range of from 0.5 mg to 2,000 mg per mol of silver halide in the internal latent image type silver halide emulsion.

28. A method of processing a direct positive silver halide photographic light-sensitive material as claimed in claim 1, 24 or 25, wherein the amount of the compound is in a range of from 1 mg to 1,000 mg per mol of silver halide in the internal latent image type silver halide emulsion.

29. A method of processing a direct positive silver halide photographic light-sensitive material as claimed in claim 1, wherein the amount of the hydroquinone is in a range of from 25 g/litter to 70 g/liter.

30. A method of processing a direct positive silver halide photographic light-sensitive material as claimed in claim 1, wherein the amount of the hydroquinone is in a range of from 30 g/liter to 65 g/liter.

31. A method of processing a direct positive silver halide photographic light-sensitive material as claimed in claim 1, wherein the hydroquinone is hydroquinone.

32. A method of processing a direct positive silver halide photographic light-sensitive material as claimed in claim 1, wherein the pH of the developing solution is in a range of from 11 to 12.5.

33. A method of processing a direct positive silver halide photographic light-sensitive material as claimed in claim 1, wherein the developing solution further contains a preservative.

34. A method of processing a direct positive silver halide photographic light-sensititive material as claimed in claim 1, wherein the developer is an aerial oxidized developer.

* * * * *